US005334571A

United States Patent [19]

Baxter

[11] Patent Number: 5,334,571

[45] Date of Patent: Aug. 2, 1994

[54] CARBONLESS PAPER FOR NON-IMPACT LASER PRINTING

[75] Inventor: George Baxter, Youngstown, Ohio

[73] Assignee: Moore Business Forms, Inc., Grand Island, N.Y.

[21] Appl. No.: 779,335

[22] Filed: Oct. 18, 1991

[51] Int. Cl.[5] ..... B41M 5/20

[52] U.S. Cl. ..... 503/226; 428/43; 428/192; 428/195; 428/198; 428/200

[58] Field of Search ..... 156/303, 552; 428/43, 428/195, 34.2, 192, 198, 200, 40; 503/226

[56] References Cited

U.S. PATENT DOCUMENTS

| | | | |
|---|---|---|---|
| 3,104,799 | 9/1963 | Steidinger | 229/69 |
| 3,916,051 | 10/1975 | Wakeman | 428/40 |
| 3,955,750 | 5/1976 | Huffman | 229/69 |
| 3,981,435 | 9/1976 | Johnsen | 229/69 |
| 3,995,808 | 12/1976 | Kehoe | 229/73 |
| 4,097,619 | 6/1978 | Davis et al. | 427/44 |
| 4,217,162 | 8/1980 | Glanz et al. | 156/305 |
| 4,230,514 | 10/1980 | Becker et al. | 156/305 |
| 4,375,868 | 3/1983 | Slotar et al. | 229/92.3 |
| 4,575,121 | 3/1986 | Conti | 281/2 |
| 4,620,726 | 11/1986 | Donnelly | 282/1 R |
| 4,624,481 | 11/1986 | Kercher | 282/11.5 A |
| 4,912,080 | 3/1990 | Weinstein | 503/200 |
| 4,925,213 | 5/1990 | Anderson | 282/12 A |
| 4,967,951 | 11/1990 | Sherman | 229/70 |
| 4,978,142 | 12/1990 | Kaluza | 282/11.5 A |
| 5,047,384 | 9/1991 | McCormick | 503/226 |
| 5,167,739 | 12/1992 | Hutchinson et al. | 156/64 |

FOREIGN PATENT DOCUMENTS

| | | | |
|---|---|---|---|
| 804435 | 1/1969 | Canada | 220/19 |
| 0008161 | 2/1980 | European Pat. Off. | B41L 1/36 |
| 1154708 | 9/1963 | Fed. Rep. of Germany | B41L 1/32 |
| 2400465 | 3/1979 | France | B65D 27/10 |
| 1507667 | 9/1989 | U.S.S.R. | B65D 27/32 |
| 535458 | 4/1941 | United Kingdom | 229/92.1 |

*Primary Examiner*—Patrick J. Ryan
*Assistant Examiner*—William A. Krynski
*Attorney, Agent, or Firm*—Nixon & Vanderhye

[57] ABSTRACT

Utilizing just five different types of sheets, multipart carbonless business forms may be printed with non-impact printers and then assembled together without using line hole punched sheets and intermediate parts. The CB sheets have an adhesive strip (continuous or discontinuous) on the CB face spaced a first distance from a sheet edge. There are first and second CF sheets, the first CF sheets having an adhesive strip (preferably linear, and continuous or discontinuous) on the CF face spaced a first distance from an edge, and the second CF sheets having an adhesive strip on the CF face thereof spaced a second distance from the edge. First and second CFB sheets are provided, the first CFB sheets having an adhesive strip on the CF face spaced the first distance, and an adhesive line on the CB face spaced the second distance; and the second CFB sheets having the adhesive strips vice-versa. The sheets are fed, in order, from trays of a non-impact (e.g., laser) printer and then are collected, and after they are formed into a stack are fed through a pressure or heat sealer which applies pressure or heat only to the adhesive strips, permanently sealing the pressure or heat activated adhesive associated with the sheets. The completed forms are collected in a bin or tray, and then ready for use as mailers, or in other types of business forms.

17 Claims, 5 Drawing Sheets

Fig. 2
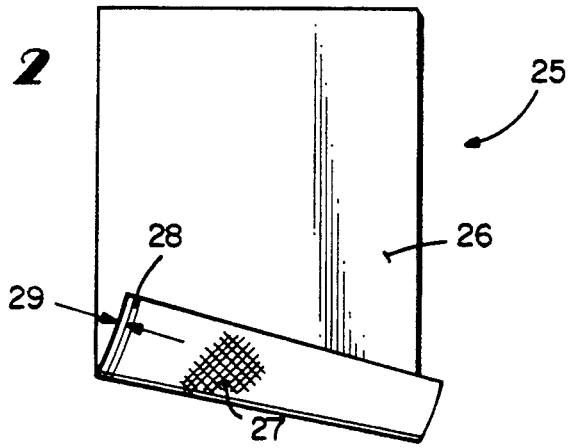
Fig. 3
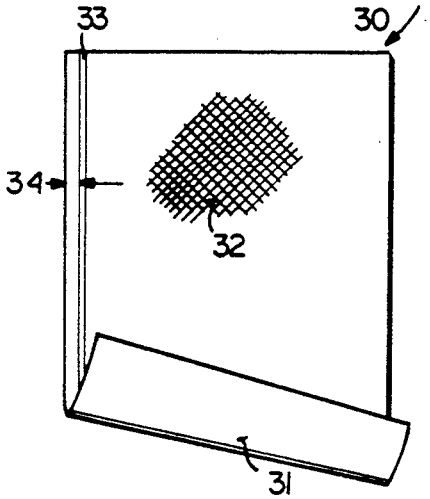
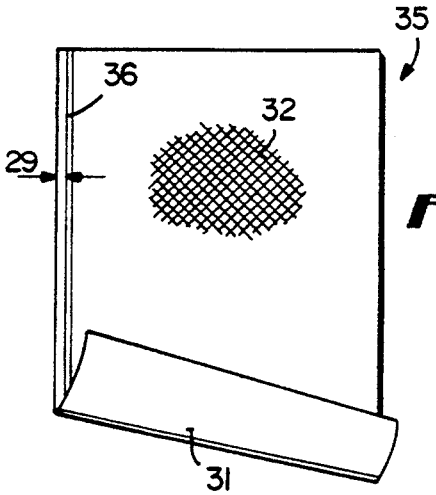
Fig. 4
Fig. 5
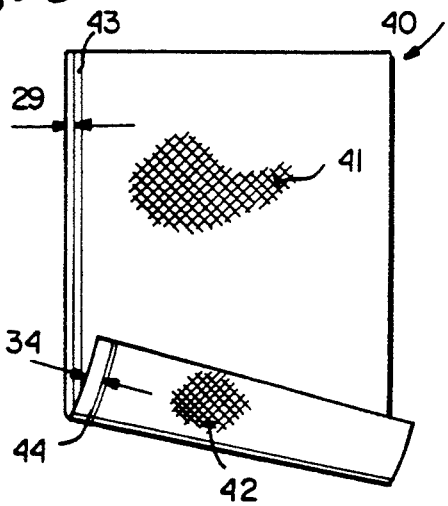
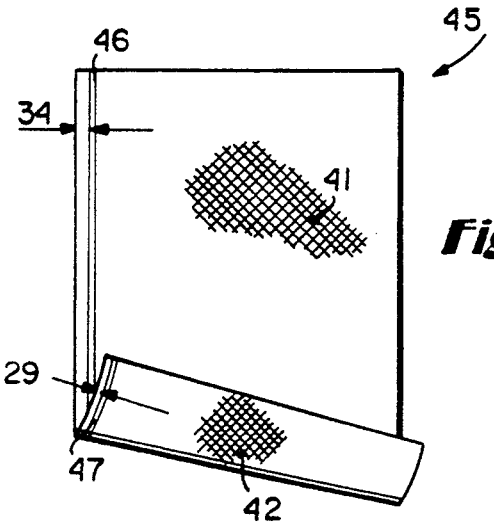
Fig. 6

Fig. 11
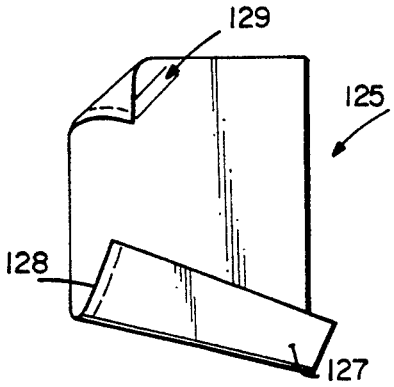
Fig. 12
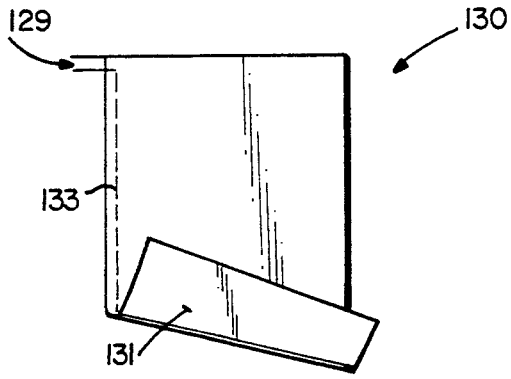
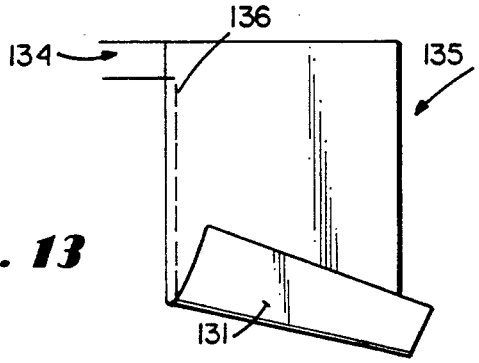
Fig. 13
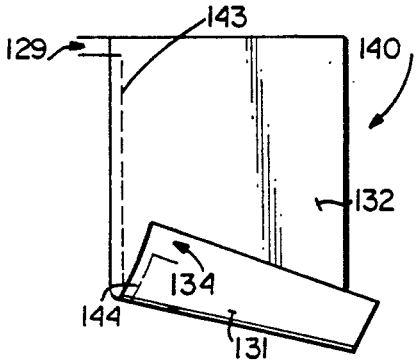
Fig. 14
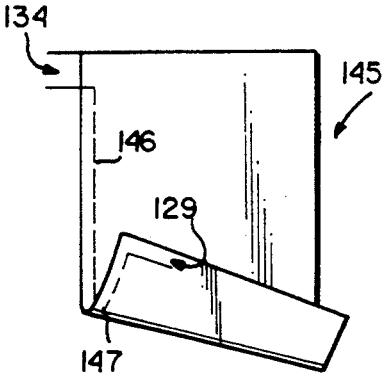
Fig. 15
Fig. 16
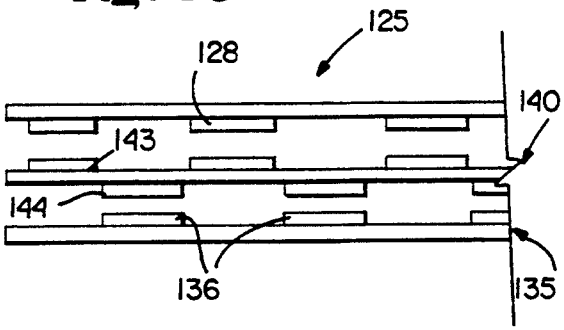

CARBONLESS PAPER FOR NON-IMPACT LASER PRINTING

BACKGROUND AND SUMMARY OF THE INVENTION

It has become increasingly popular to use high speed non-impact printers (e.g. laser printers, such as the Xerox 9790, Kodak 1392, and IBM 3827) in the production of carbonless business forms. However, in a typical manufacture of carbonless business forms utilizing such sheets, line hole punch intermediate parts must be utilized. This is undesirable in many situations.

According to the present invention, it is possible to utilize high speed non-impact printers—typically having two infeed lines for printing paper—to form multiple part carbonless business forms without the necessity of using line hole punch sheets in the intermediate parts. Almost any finite number of parts can be produced, from either straight precollated or reverse precollated infeeds.

One of the keys to the present invention is the provision of the parts necessary in order to construct multipart forms so that they have a minimum number of configurations, yet may be utilized to produce carbonless business forms of any number of parts—e.g., five- and six-part forms are readily produced according to the invention, and utilizing the same sheets as the two, three, and four-part forms.

According to one aspect of the present invention, an assembly of sheets for constructing carbonless multipart business forms is provided, typically disposed in trays of a non-impact printer. The sheets comprise: a plurality of CB sheets of the same construction, each of the CB sheets having a first edge with an adhesive strip on the CB face spaced a first distance from the first edge. A plurality of each of two different types of CF sheets, comprising first and second CF sheets, each of the first CF sheets having an adhesive strip on the CF face spaced the first distance from a first edge thereof, and each of the second CF sheets having an adhesive strip on the CF face spaced a second distance from the first edge thereof; and a plurality of each of two different types of CFB sheets, comprising first and second CFB sheets, each of the first CFB sheets having an adhesive strip on the CF face spaced the first distance from a first edge thereof, and an adhesive strip on the CB face spaced the second distance from the first edge, and each of the second CFB sheets having an adhesive strip on the CF face spaced the second distance from the first edge thereof, and an adhesive strip on the CB face spaced the first distance from the first edge thereof.

Each of the adhesive strips is preferably linear, although they may have other geometric configurations, and may be either continuous or discontinuous. Preferably, the adhesive is pressure activated permanent adhesive, such as that sold commercially by Moore Business Forms, Inc. of Lake Forest, Illinois, and acted upon by a commercial Moore pressure sealer Model 4800B. Strips of adhesive need not be applied adjacent to just one edge, but may be applied to two or more edges. The first distance is typically about 1/16 to about ⅛ inch, while the second distance is about ¼ to about ⅜ inch, while each strip has a width of about ⅛ inch. Perforations, or like conventional form constructions, may be associated with the sheets, e.g. adjacent to the adhesive lines.

While pressure sensitive adhesive is preferred, heat activated adhesive may also be employed. Such adhesive could be used with a Moore Heat Sealer Model 4200 (see U.S. Pat. No. 4,818,332), or a Moore Edge Sealer.

The sheets, after printing with a non-impact printer, may be assembled into multipart business forms. A three-part business form has, in sequence, from top to bottom, a CB sheet, a first CFB sheet, and a second set CF sheet. A four-part form has in sequence, from top to bottom, a CB sheet, a first CFB sheet, a second CFB sheet, and a first CF sheet, A five-part form has in sequence, from top to bottom, a CB sheet, a first CFB sheet, a second CFB sheet, a first CFB sheet, and a second CF sheet. A six-part form has in sequence, from top to bottom, a CB sheet, a first CFB sheet, a second CFB sheet, a first CFB sheet, a second CFB sheet, and a first CF sheet.

According to another aspect of the present invention, a method of assembling carbonless multipart forms with any number of desired parts, without using line hole punched sheets is provided. The method comprises the steps of: (a) Feeding a CB sheet to a collecting station. (b) Feeding a first CFB sheet to the collecting station so that the adhesive strip on the CF face thereof is in alignment with the adhesive strip on the CB sheet CB face, to initiate a stack of sheets at the collecting station; and (c) feeding at least one other sheet, including a CF sheet, to the collecting station so that the adhesive strips on each sheet face are in alignment with like adhesive strips on the adjacent sheets in the stack of sheets in the collecting station. Preferably there is the further step (d), after step (c) of applying heat and/or pressure to the stack of sheets, with aligned adhesive strips, at the aligned adhesive strips only, so that the adhesive—which is pressure or heat activated permanent adhesive—seals the sheets together. Also, there preferably is the further step of individually printing each sheet with a non-impact printer during feeding of each sheet to the collecting station. Step (c) is practiced, feeding the appropriate sheets from appropriate trays or other sources of paper for the laser printer, to produce the three, four, five and six multipart forms described above (or any other number of parts).

The invention also contemplates equipment for forming carbonless multipart business forms from CB, CF and/or CFB sheets having aligned strips of heat and/or pressure activated permanent adhesive thereon. The equipment comprises: A non-impact printer having at least first and second sources for CB, CF, and/or CFB sheets, and a printed sheet discharge. An accumulator connected to the printed sheet discharge of the printer, for accumulating and aligning printed sheets from the printer so that they are in precisely aligned stacks, the accumulator having an accumulated stack discharge. A pressure sealer connected to the accumulated stack discharge of the accumulator for applying pressure only to the strips of pressure activated adhesive on the stacked sheets to permanently seal the sheets together, the pressure sealer having a discharge. And, collecting means for collecting sealed forms from the pressure sealer, the collecting means connected to the discharge from the pressure sealer. All of the collecting means, pressure sealer, accumulator, and printer are preferably on wheeled supports, so that they can be easily moved into operative association with each other. A heat sealer could be used in place of the pressure sealer.

It is a primary object of the present invention to provide for the effective manufacture of multipart carbonless business forms utilizing non-impact printers, without the necessity of utilizing line hole punched sheets in the intermediate parts. This and other objects of the invention will become clear from an inspection of the detailed description of the invention, and from the appended claims.

BRIEF DESCRIPTION OF THE DRAWINGS

FIG. 2 is a top plan view, with the bottom of the sheet curled up to illustrate the rear face thereof, of a first embodiment of an exemplary CB sheet according to the invention;

FIGS. 3 through 6 are views like that of FIG. 2 but for, respectively, a second CF sheet, a first CF sheet, a first CFB sheet, and a second CFB sheet, according to a first exemplary embodiment of the invention;

FIGS. 11–15 are views like those of FIGS. 2–6, respectively, only for another exemplary embodiment of form sheets according to the present invention; and FIG. 16 is a detail, enlarged, exploded, side view of an exemplary three-part business form produced according to the invention from the sheets of the FIGS. 11–15 embodiment.

DETAILED DESCRIPTION OF THE DRAWINGS

Figure 1:
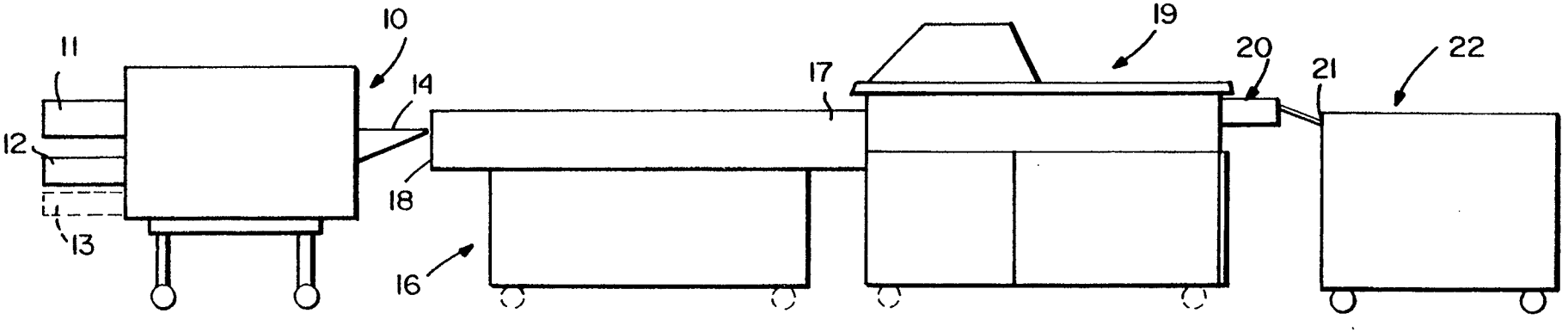
FIG. 1 is a schematic side view of exemplary equipment according to the invention, for practicing the method according to the invention.

Exemplary equipment according to the invention, and utilized to practice the method according to the invention, is illustrated schematically in FIG. 1. The equipment includes a high speed non-impact (e.g. laser) printer 10, such as a Xerox 9790, Kodak 1392, or IBM 3827. The printer 10 has two or more infeed lines (e.g. trays) 11, 12, 13, typically two trays 11, 12 being provided, and a printed sheet discharge 14. The printer discharge 14 is connected to an inlet conveyor 18 for a conventional accumulator 16. The accumulator 16 accumulates and aligns printed sheets from the printer 10 so that they are in precisely aligned stacks, and they are ultimately discharged in precisely aligned stacks from the accumulated stack discharge 17 of the accumulator 16. If feed directly from a printer to an accumulator is not desired, then a high speed stand alone unit, such as a model 418 manufactured by GBR of Massachussetts, can be utilized instead.

The discharge 17 is connected to an inlet conveyor section of a conventional pressure sealer 19, such as a Moore Business Forms, Inc. 4800B pressure sealer. The pressure sealer 19 applies pressure with narrow rollers, only above the strips of pressure activated adhesive on the stacked sheets fed from the accumulator 16, to permanently seal the sheet edges together. The pressure sealer may seal one, two, or any other number of strips, it being only necessary to align pressure sealing rollers with the strips that will be fed to the pressure sealer 19.

Instead of a pressure sealer, a heat sealer could be utilized, such as a Moore Heat Sealer Model 4200, or a Moore Edge Sealer.

Completed multipart forms are discharged from the discharge conveyor section 20 of the pressure sealer 19, being fed to an inlet 21 to a collecting means 22. The collecting means 22—which may merely be a bin or tray, although it may have a vertically movable horizontal collecting surface—is connected to the discharge 20 from the pressure sealer 19. After the forms are collected in the collecting means 22, they may be acted upon as desired depending upon the use thereof. For example, if they are mailers, they can be folded and otherwise assembled into a final configuration, or if suitable additional equipment is utilized, a folder and another pressure sealer may be provided between the pressure sealer 19 and the collecting means 22 so that the collecting means 22 is connected to the pressure sealer 19 through the folder and additional pressure sealer.

As illustrated in FIG. 1, all of the pieces of equipment 10, 16, 19, 22 can be mounted on wheeled supports. This allows the equipment components to be moved into ready operative association with each other. Alternatively, the laser printer 10 may be a stationary type while the rest of the equipment is mobile.

Almost any finite number of parts may be provided in the multipart forms constructed according to the present invention, despite the fact that there are only five different configurations of sheets. These five different configurations are illustrated in FIGS. 2 through 6. All of the sheets are preferably paper, and have microencapsulated coatings thereon so that the business forms produced are carbonless.

FIG. 2 illustrates a CB sheet 25 according to the invention, which has a front, plain paper sheet 26 and a CB rear face 27. Disposed on the rear face 27 is an adhesive strip 28, which is spaced a first distance 29 from the left longitudinal (side) edge of the sheet 25. The strip 28 is preferably linear and parallel to the longitudinal edge from which it is spaced the distance 29—as illustrated—but may have other geometric configurations.

FIGS. 3 and 4 illustrate two different types of CF sheets. A second CF sheet 30 has a rear face 31 of plain paper, with the front face 32 being a CF face. An adhesive strip 33 is provided on the CF face 32 spaced a second distance 34 from the left longitudinal (side) edge of the sheet 30, and preferably is linear, and parallel to the edge. The first CF sheet 35 illustrated in FIG. 4 is the same as that of FIG. 3 only the adhesive strip 36 thereof is spaced the first distance 29 from the left side edge.

Two different types of CFB sheets according to the invention are illustrated in FIGS. 5 and 6. FIG. 5 illustrates a first CFB sheet 40 having a CF face 41 and a CB face 42. On the CF face 41 there is disposed an adhesive strip 43 spaced the first distance 29 from the left edge thereof, while on the CB face sheet 42 is the adhesive strip 44, spaced the second distance 34 from the left edge. FIG. 6 shows a second CFB sheet 45 according to the invention. In the sheet 45 the adhesive strip 46 on the CF face is spaced the second distance 34 from the left longitudinal edge of the sheet 45, while the adhesive strip 47 is spaced the first distance 29. Of course, the sheets 40, 45 are paper between CF and CB (containing microcapsules) coatings, e.g., see the paper intermediate portion 48 of the first sheet 40 (FIG. 7) and the paper intermediate portion 49 of the second CFB sheet 45 (FIGURE S).

The adhesives forming the adhesive strips 28, 33, etc. of the sheets 25, 30, 35, 40, 45 is preferably pressure activated permanent adhesive of the type produced by Moore Business Forms of Lake Forest, Ill. and utilized with the Moore 4800B pressure sealer. Alternatively it may be heat activated adhesive, such as that conventionally utilized with a Moore Heat Sealer Model 4200. The first spacing 29 is preferably between about 1/16 and ⅛ inch from the edge of a sheet, and is preferably linear and continuous along the length of the sheet printed, so that the spacing is the same along the length. Of course, the strip may be staggered so that the first distance really comprises multiple distances along the length, as long as the pattern from one sheet to the next is the same. The second distance 34 preferably is about ¼ inch to about ⅜ inch, and again preferably is constant (that is, the adhesive associated therewith is linear). While the width of the adhesive strips 28, 33, etc. will depend upon the particular adhesive utilized, preferably the width is about ⅛ inch.

Figure 9:
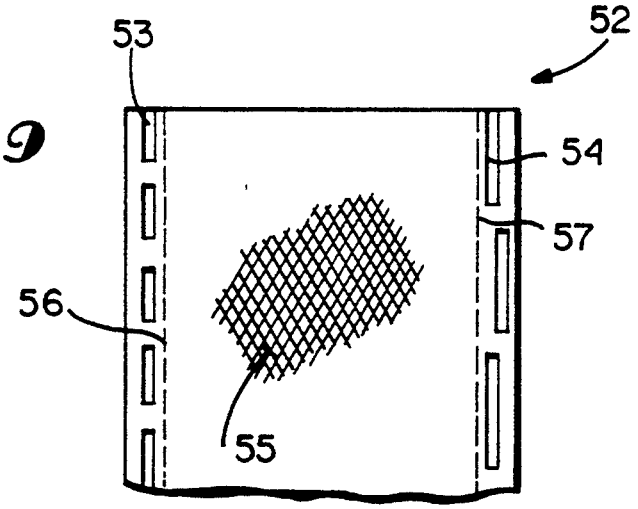
FIG. 9 is a a top plan view of an exemplary sheet of a multipart form according to the invention showing discontinuous, multiple, adhesive strips, and perforations, which are optional features for all of the sheets of FIGS. 2 through 6.

While the adhesive strips are shown as continuous and linear in FIGS. 2 through 6, the strips may be discontinuous and staggered, or have other geometric configurations. In FIG. 9, a discontinuous linear strip is illustrated by reference numeral 53, while a discontinuous staggered strip is illustrated by reference numeral 54.

While FIGS. 2 through 6 also show only one strip associated with each face of a sheet that has a strip, as seen in FIG. 9, adhesive strips may be associated with two, three, or even all four edges (and some intermediate parts) of a sheet, as is true for the sheet 52 in FIG. 9. In the sheet 52 of FIG. 9, the second adhesive strip 54 has the same relationship with respect to the right side longitudinal edge as the strip 53 has with respect to the left side longitudinal edge, so that, again, only five different types of sheets are necessary to produce any finite number of parts of a multipart business form.

As illustrated for the sheet 52 in FIG. 9, perforations, such as the perforations 56, 57, score lines or any other type of normal business form construction elements, may be utilized in association with the sheets. Perforations 56, 57 would be particularly useful, being disposed on the opposite sides of the adhesive strips 53, 54 from the edges with which those strips are associated, so that the adhesive portions of the form may be detached prior to an end user utilizing the form.

Figure 7:
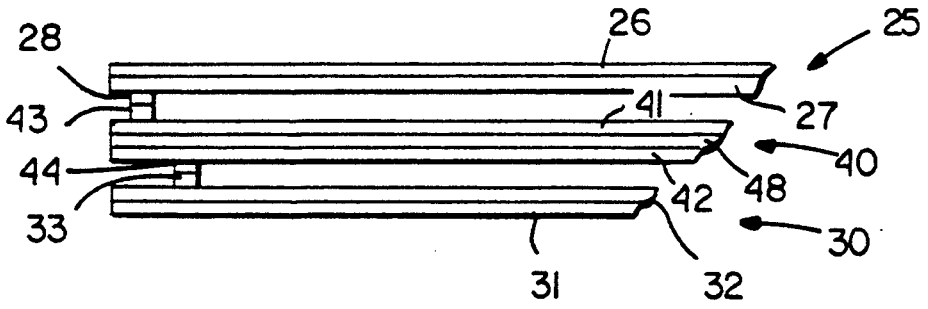
FIG. 7 is a detailed schematic enlarged end view of an exemplary three-part business form manufactured utilizing the sheets of FIGS. 2 through 6.

FIG. 7 illustrates a three-part business form constructed according to the invention. The form has, in sequence from top to bottom, a CB sheet 25, a first CBF sheet 40, and a second CF sheet 30. Note the alignment of the adhesive strips 28, 43, and 44, 33, respectively. In the pressure sealer 19 one set of rollers is disposed directly above the strips 28, 43, and a second set above the strips 44, 33; or a common roller (but having a width no greater than the second distance plus the width of the strips 44, 33) applies the pressure necessary to permanently adhere the parts together.

Figure 8:
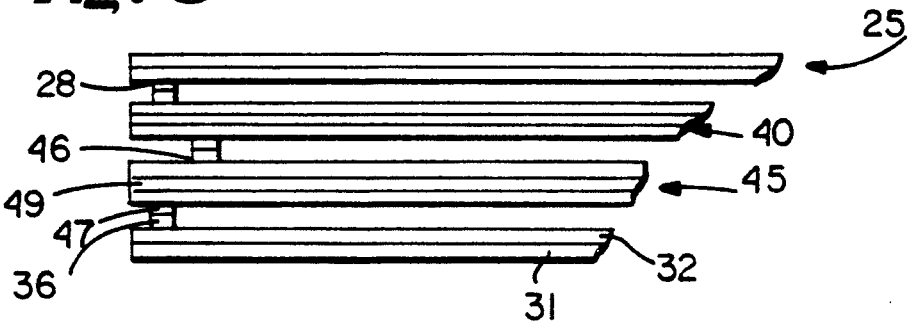
FIG. 8 is a view like that of FIG. 7 for an exemplary four-part business form.

FIG. 8 illustrates an exemplary four-part business form according to the invention. This includes, from top to bottom, a CB sheet 25, a first CFB sheet 40, a second CFB sheet 45, and a first CF sheet 35. Any number of parts may be provided. For example, in a five-part form, from top to bottom, in sequence, it would be a CB sheet 25, a first CFB sheet 40, a second CFB sheet 45, a first CFB sheet 40, and a second CF sheet 30. For a six-part form there would be, in sequence, from top to bottom, a CB sheet 25, a first CFB sheet 40, a second CFB sheet 45, a first CFB sheet 40, a second CFB sheet 45, and a first CF sheet 35.

Assuming that the laser printer 10 has two infeed bins 11, 12, the following table sets forth the manner of feeding from the bins, in each case, bin No. 1 feeding one sheet first, and then the next sheet being fed from bin No. 2, etc. The types of sheets are indicated by the reference numerals used with respect to FIGS. 2 through 6:

| No. Parts in Form Set | Infeed Bin #1(11) | Infeed Bin #2(12) |
|---|---|---|
| 2 | 25 | 35 |
| 3 (straight precollated) | 25, 30 | 40 |
| 3 (reverse precollated) | 30, 40, 25 | — |
| 4 (straight precollated) | 25, 45 | 40, 35 |
| 4 (reverse precollated) | 45, 25 | 35, 40 |
| 5 (straight precollated) | 25, 45, 30 | 40, 40 |
| 5 (reverse precollated) | 30, 45, 25 | 40, 40 |
| 6 (straight precollated) | 25, 45, 45 | 40, 40, 35 |
| 6 (reverse precollated) | 45, 45, 25 | 35, 40, 40 |

Figure 10:
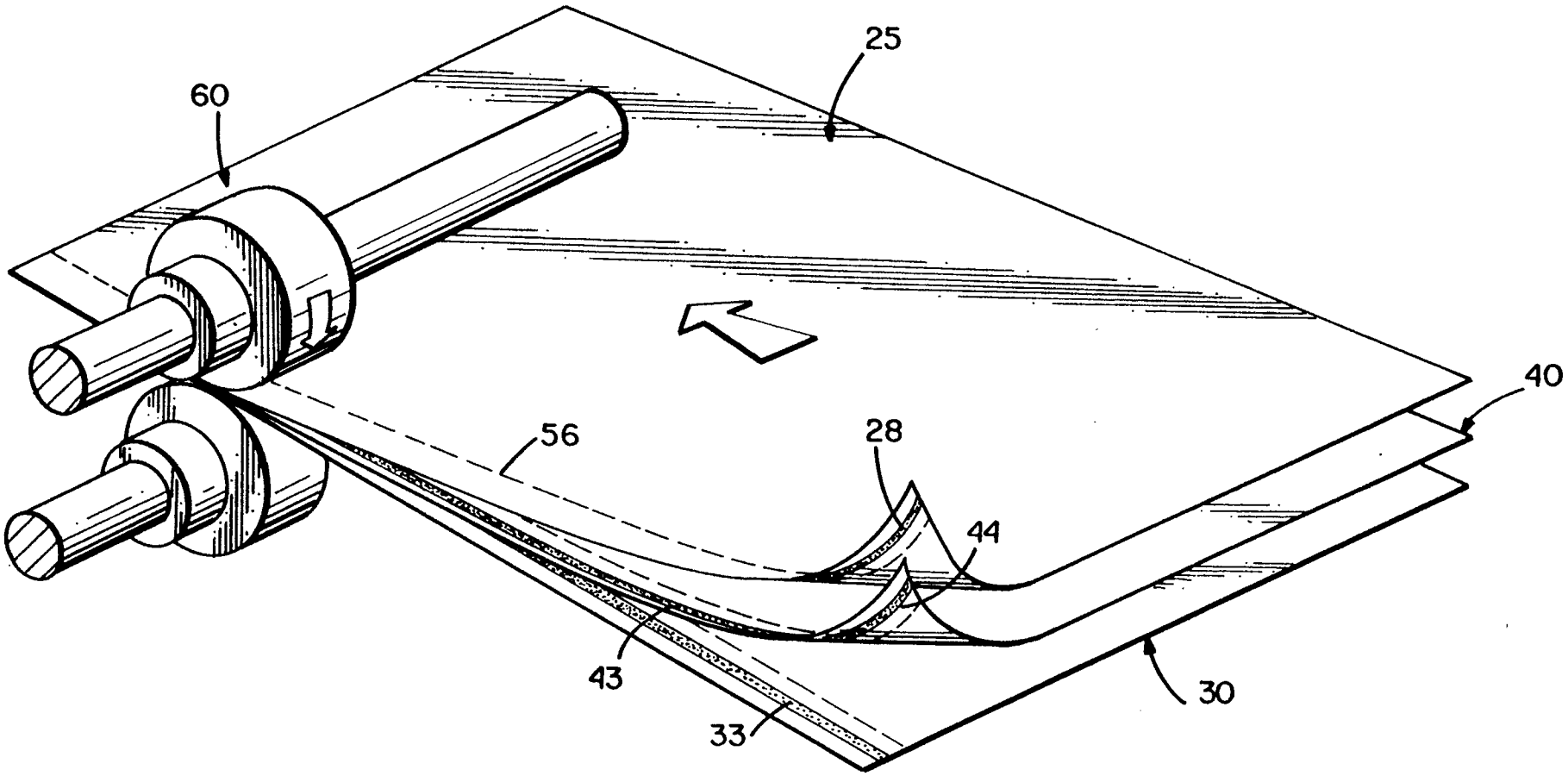
FIG. 10 is a perspective view showing the rollers of a pressure sealer acting on the pressure adhesive strips of the three part form of FIG. 7 to seal one edge of the form.

Utilizing the equipment illustrated in FIG. 1 and the sheets of FIGS. 2 through 6, a method of assembling carbonless multipart forms with any number of desired parts, without using line hole punch sheets is provided which comprises the following steps: (a) Feeding a CB sheet 25 to a collecting station (16). (b) Feeding a first CFB sheet 40 to the collecting station (16) so that the adhesive lines 28, 43 are in alignment to initiate a stack of sheets at the station (16). (c) Feeding at least one other sheet, either one or more CFB sheets 45, 40 and including a CF sheet, either a sheet 30 or sheet 35, depending upon the number of parts in the form to be produced, to the collecting station (16) so that the adhesive strips in each sheet face are in alignment with like adhesive strips on the adjacent sheets in the stack of sheets in the collecting station (16). And (d) Applying heat and/or pressure to the stack of sheets, with aligned adhesive strips, at the aligned adhesive strips only, to seal the sheets together to produce multipart forms (e.g. see FIGS. 7 and 8). FIG. 10 illustrates the rollers 60 of an exemplary pressure sealer 19 according to the present invention to form a three-part form. Prior to step (a) there is also the further step of individually printing each sheet 25, 30, 35, 40, 45 with the non-impact (e.g. laser) printer 10 during the feeding of the sheet to the station 16.

FIGS. 11–16 illustrate a second exemplary embodiment of standard sheets utilized to construct multipart business forms according to the present invention. The only significant difference between the FIGS. 11–16 embodiment and the FIGS. 2–8 embodiment is in the exact positioning of the adhesive strips. In the FIGS. 11–16 embodiment, the adhesive strips are discontinuous and spaced a predetermined distance from the top and/or bottom edge of the sheet, so that they are interspersed with each other in a particular manner. In the FIGS. 11–16 embodiment sheets and structures comparable to those in the FIGS. 2–8 embodiment are shown by the same two digit reference numeral, only preceded by a "1".

Sheet 125 is the single construction of CB sheet according to the invention, having the discontinuous pressure or heat activated adhesive strip 128 on the back side 127 thereof. The start of the strip 128 is spaced a first distance 129 from the top and/or bottom edge of the sheet 125—as seen in FIG. 11. The strip 128 is preferably linear, and is essentially perpendicular to the top or bottom edge from which it is spaced the distance 129. The two types of CF sheets, 130, 135, are shown in FIGS. 12 and 13, and the two types of CFB sheets 140, 145, are shown in FIGS. 14 and 15. Note that the first CFB sheet 140 has the same spacing 129 of the adhesive strip 143 on the front face 132 thereof as the strip 128 on sheet 125, while its back side 131 has a second spacing 134 of its adhesive strip from the top and/or bottom edge of the sheet, which spacing 134 is typically the length of one of the segments (if regular) of the adhesive strip plus the distance 129. The adhesive strips 128, 133, 136, 143, 144, 146, and 147 are all spaced the same distance from the longitudinal (side) edge of the sheets with which they are associated, so that they are in alignment in a vertical plane.

Preferably, the segments making up each discontinuous adhesive strip 128, 133, 136, 143, 144, 146, and 147 are of uniform length, and are spaced apart from each other a distance corresponding to their length. Thus, when they are aligned with each other—as illustrated for the three-part form in FIG. 16—the strips on adjacent faces will match up exactly (the segments of strip 128 match those of strip 143, and the segments of strip 144 match those of 136 in FIG. 16), while those for the next set of sheet faces will be interspersed.

The following table sets forth the manner of feeding from the laser printer bins 11, 12 for the FIGS. 11–16 embodiment:

| No. Parts in Form Set | Infeed Bin #1(11) | Infeed Bin #2(12) |
|---|---|---|
| 2 | 125 | 130 |
| 3 (straight precollated) | 125, 135 | 140 |
| 3 (reverse precollated) | 135, 140, 125 | — |
| 4 (straight precollated) | 125, 145 | 140, 130 |
| 4 (reverse precollated) | 145, 125 | 130, 140 |
| 5 (straight precollated) | 125, 145, 135 | 140, 140 |
| 5 (reverse precollated) | 135, 145, 125 | 140, 140 |
| 6 (straight precollated) | 125, 145, 145 | 140, 140, 130 |
| 6 (reverse precollated) | 145, 145, 125 | 130, 140, 140 |

It will thus be seen that according to the present invention an advantageous method of assembling carbonless multipart forms, an advantageous assembly of sheets for constructing carbonless multipart forms, and equipment for advantageously manufacturing carbonless multipart forms from CB, CF and/or CFB sheets having aligned continuous or discontinuous strips of pressure or heat activated permanent adhesive thereon, have been provided. While the invention has been herein shown and described in what is presently conceived to be the most practical and preferred embodiment thereof, it will be apparent to those skilled in the art that many modifications may be made thereof within the scope of the invention, which scope is to be accorded the broadest interpretation of the appended claims so as to encompass all equivalent structures and methods.

What is claimed is:

1. An assembly of sheets, wherein adjacent sheets have aligned adhesive strips, for constructing carbonless multipart business forms, said sheets disposed in trays of a non-impact printer, the sheets comprising:

a plurality of CB sheets of the same construction, each of the CB sheets having a first edge with an adhesive strip on the CB face spaced a first distance from the first edge;

a plurality of each of two different types of CF sheets, comprising first and second CF sheets, each of the first CF sheets having an adhesive strip on the CF face spaced the first distance from a first edge thereof, and each of the second CF sheets having an adhesive strip on the CF face spaced a second distance from the first edge thereof, said second distance offset from said first distance by at least a width of said adhesive strip; and a plurality of each of two different types of CFB sheets, comprising first and second CFB sheets, each of the first CFB sheets having an adhesive strip on the CF face spaced the first distance from a first edge thereof, and an adhesive strip on the CB face spaced the second distance from the first edge, and each of the second CFB sheets having an adhesive strip on the CF face spaced the second distance from the first edge thereof, and an adhesive strip on the CB face spaced the first distance from the first edge thereof.

2. An assembly as recited in claim 1 wherein each of said adhesive strips is linear and continuous, and essentially parallel to the first edge of the sheet with which they are associated, and wherein the first edges of the sheets are longitudinal edges.

3. An assembly as recited in claim 1 wherein at least some of said adhesive strips are discontinuous.

4. An assembly as recited in claim 1 wherein the adhesive strips are regularly discontinuous, linear, adhesive strips having segments of common length, and spaced from each other a distance corresponding to that common length, and the strips are essentially perpendicular to the first edge of the sheet with which they are associated.

5. An assembly as recited in claim 1 wherein each of the sheets has a second adhesive strip on each face thereof which has an adhesive strip, the second adhesive strip having substantially the same orientation with respect to a second edge of the sheet as the first strip has to the first edge.

6. An assembly as recited in claim 1 wherein the adhesive is selected from the group consisting of pressure activated permanent adhesive and heat activated permanent adhesive.

7. An assembly as recited in claim 1 wherein the adhesive strips are essentially parallel to the first edge, and further comprising a perforation strip formed in each sheet adjacent an adhesive strip, but spaced further from said first edge than either said first or second distances.

8. An assembly as recited in claim 6 wherein each strip is linear and essentially parallel to the first edge, and said first and second distances are constant along the entire length of each of said sheets, and wherein said first distance is about one sixteenth to about eighth inch, and wherein said second distance is about one quarter to about three eighths inch.

9. An assembly as recited in claim 8 wherein each strip has a uniform width, the width being about one eighth inch.

10. An assembly as recited in claim 6 wherein the sheets, after printing with the non-impact printer, are assembled into a multipart business form, said form comprising a three part form having in sequence, from top to bottom, a CB sheet, a first CFB sheet, and a second CF sheet.

11. An assembly as recited in claim 6 wherein the sheets, after printing with the non-impact printer, are assembled into a multipart business form, said form comprising a four-part form having in sequence, from top to bottom, a CB sheet, a first CFB sheet, a second CFB sheet, and a first CF sheet.

12. An assembly as recited in claim 6 wherein the sheets, after printing with the non-impact printer, are assembled into a multipart business form, said form comprising a five-part form having in sequence, from top to bottom, a CB sheet, a first CFB sheet, a second CFB sheet, a first CFB sheet, and a second CF sheet.

13. An assembly as recited in claim 6 wherein the sheets, after printing with the non-impact printer, are assembled into a multipart business form, said form comprising a six-part form having in sequence, from top to bottom, a CB sheet, a first CFB sheet, a second CFB sheet, a first CFB sheet, a second CFB sheet, and a first CF sheet.

14. An assembly as recited in claim 2 wherein the adhesive is pressure activated permanent adhesive, and the strips are of constant width.

15. An assembly as recited in claim 2 wherein the adhesive is heat activated permanent adhesive, and the strips are of constant width.

16. An assembly as recited in claim 1 wherein each of said sheets has second, third, and fourth edges, and an adhesive strip like that associated with said first edge associated with at least one of said second, third and fourth edges.

17. An assembly as recited in claim 1 wherein at least some of said adhesive strips are regularly discontinuous segments aligned in a linear direction.

* * * * *